US006658695B1

(12) United States Patent
Genua

(10) Patent No.: US 6,658,695 B1
(45) Date of Patent: Dec. 9, 2003

(54) DOOR SECURING DEVICE

(76) Inventor: Paul S. Genua, 139 Trothen Cir., Markham Ont. L3P 4H4 (CA)

( * ) Notice: Subject to any disclaimer, the term of this patent is extended or adjusted under 35 U.S.C. 154(b) by 0 days.

(21) Appl. No.: 10/215,591

(22) Filed: Aug. 9, 2002

(51) Int. Cl.[7] ..... E05F 3/00

(52) U.S. Cl. ..... 16/66; 16/71; 16/49; 16/82; 16/84; 16/DIG. 10

(58) Field of Search ..... 16/66, 67, 71, 16/72, 78, 49, 82, 84, 85, DIG. 10, DIG. 17; 49/386, 394; 292/305, 306, 262, 266, 277, 275, DIG. 4, DIG. 12, DIG. 15, DIG. 17

(56) References Cited

U.S. PATENT DOCUMENTS

| | | | | | |
|---|---|---|---|---|---|
| 3,579,708 | A | * | 5/1971 | Lee | 16/52 |
| 3,785,004 | A | | 1/1974 | Stoffregen | |
| 3,934,306 | A | * | 1/1976 | Farris | 16/48.5 |
| 4,194,264 | A | | 3/1980 | Stoffregen | |
| 4,722,116 | A | | 2/1988 | Erickson | |
| 4,815,163 | A | | 3/1989 | Simmons | |
| 5,048,150 | A | * | 9/1991 | Guerin | 16/49 |
| D356,938 | S | | 4/1995 | Duffy | |
| 5,592,780 | A | * | 1/1997 | Checkovich | 49/386 |
| 5,622,007 | A | * | 4/1997 | Archer | 49/404 |
| 5,630,248 | A | * | 5/1997 | Luca | 16/71 |
| 5,659,925 | A | | 8/1997 | Patterson | |
| 5,832,562 | A | * | 11/1998 | Luca | 16/71 |

FOREIGN PATENT DOCUMENTS

| | | | |
|---|---|---|---|
| DE | 3142959 A1 | * | 3/1983 |
| WO | WO 96/12077 | * | 4/1996 |

* cited by examiner

*Primary Examiner*—Chuck Y. Mah

(57) ABSTRACT

A door securing device for securing screen door in an open position once it has been opened. The door securing device includes a housing comprising a perimeter wall. The perimeter wall defines an interior space of the housing. The housing is designed for being slidably positioned on a door rod of the screen door opposite a door cylinder of the screen door. A cable assembly is positioned in the interior space of the housing. The cable assembly is designed for being coupled to the screen door opposite the housing. The cable assembly is designed for drawing the housing towards the door cylinder whereby the housing engages the door cylinder and the door rod to maintain the door cylinder in position on the door rod for inhibiting closing of the screen door.

9 Claims, 6 Drawing Sheets

DOOR SECURING DEVICE

BACKGROUND OF THE INVENTION

1. Field of the Invention

The present invention relates to door holding mechanisms and more particularly pertains to a new door securing device for securing screen door in an open position once it has been opened.

2. Description of the Prior Art

The use of door holding mechanisms is known in the prior art. U.S. Pat. No. 5,659,925 describes a device for engaging the door cylinder of a door and maintain position of the door cylinder to inhibit the door cylinder from closing the door. Another type of door holding mechanism is U.S. Pat. No. 3,785,004 having a device being coupled to a door check unit for keeping a door in a fully opened position. U.S. Pat. No. 4,194,264 has a releasable latch for engaging a door check unit to selectively inhibit closing the screen door until released by the user. U.S. Pat. Nos. 4,722,116 and 4,815,163 each have a mechanism for engaging the door check unit of a screen door for securing the screen door in an open position. U.S. Pat. No. Des. 356,938 shows an attachment to prevent the operation of a storm door closer mechanism.

SUMMARY OF THE INVENTION

Still yet another object of the present invention is to provide a new door securing device that does not require the hands of the user to set the housing in position against the door cylinder.

Even still another object of the present invention is to provide a new door securing device that is easily removable when not needed.

To this end, the present invention generally comprises a housing comprising a perimeter wall. The perimeter wall defines an interior space of the housing. The housing is designed for being slidably positioned on a door rod of the screen door opposite a door cylinder of the screen door. A cable assembly is positioned in the interior space of the housing. The cable assembly is designed for being coupled to the screen door opposite the housing. The cable assembly is designed for drawing the housing towards the door cylinder whereby the housing engages the door cylinder and the door rod to maintain the door cylinder in position on the door rod for inhibiting closing of the screen door.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
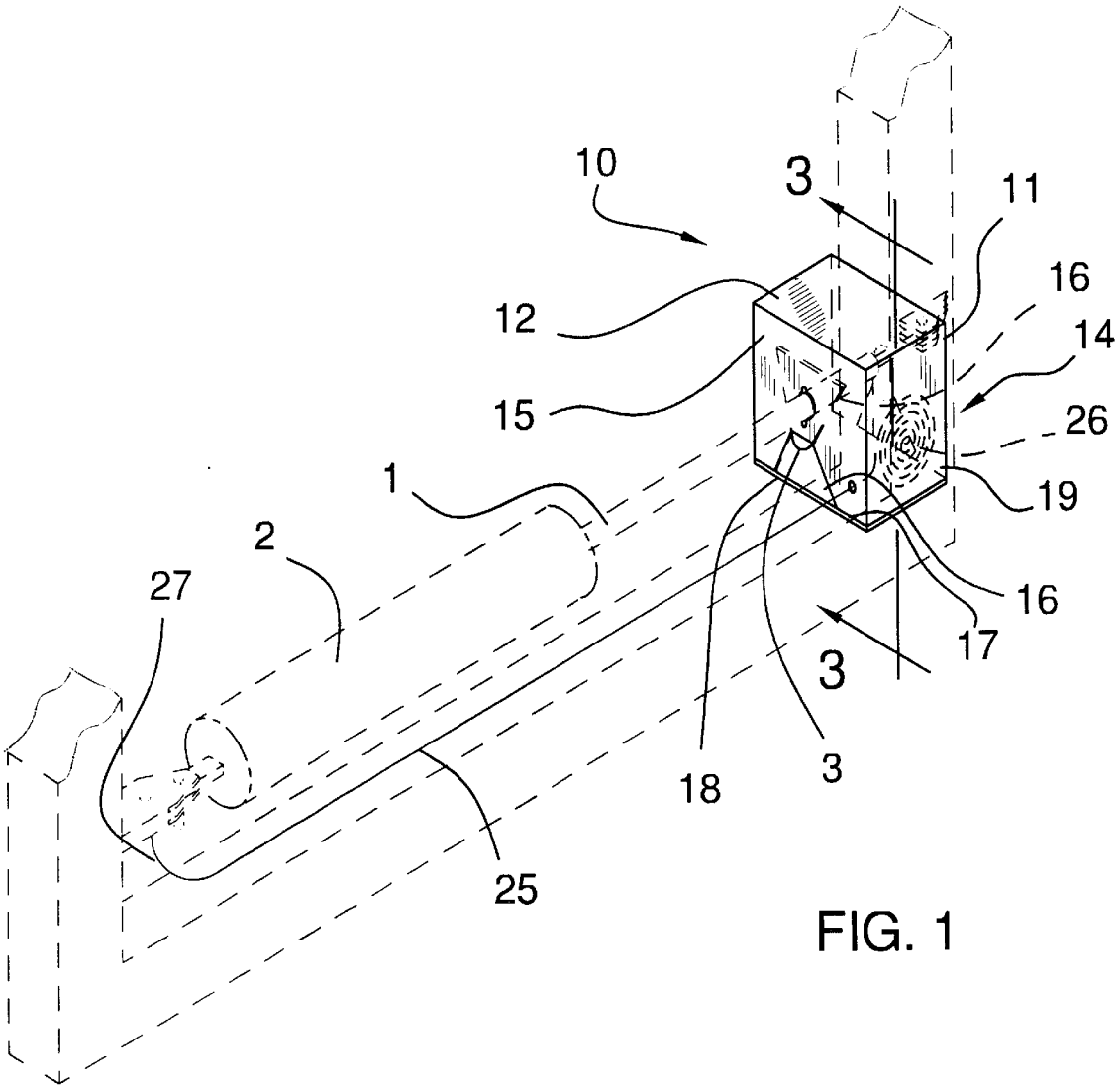
FIG. 1 is a perspective view of a new door securing device according to the present invention shown in use.
Figure 2:
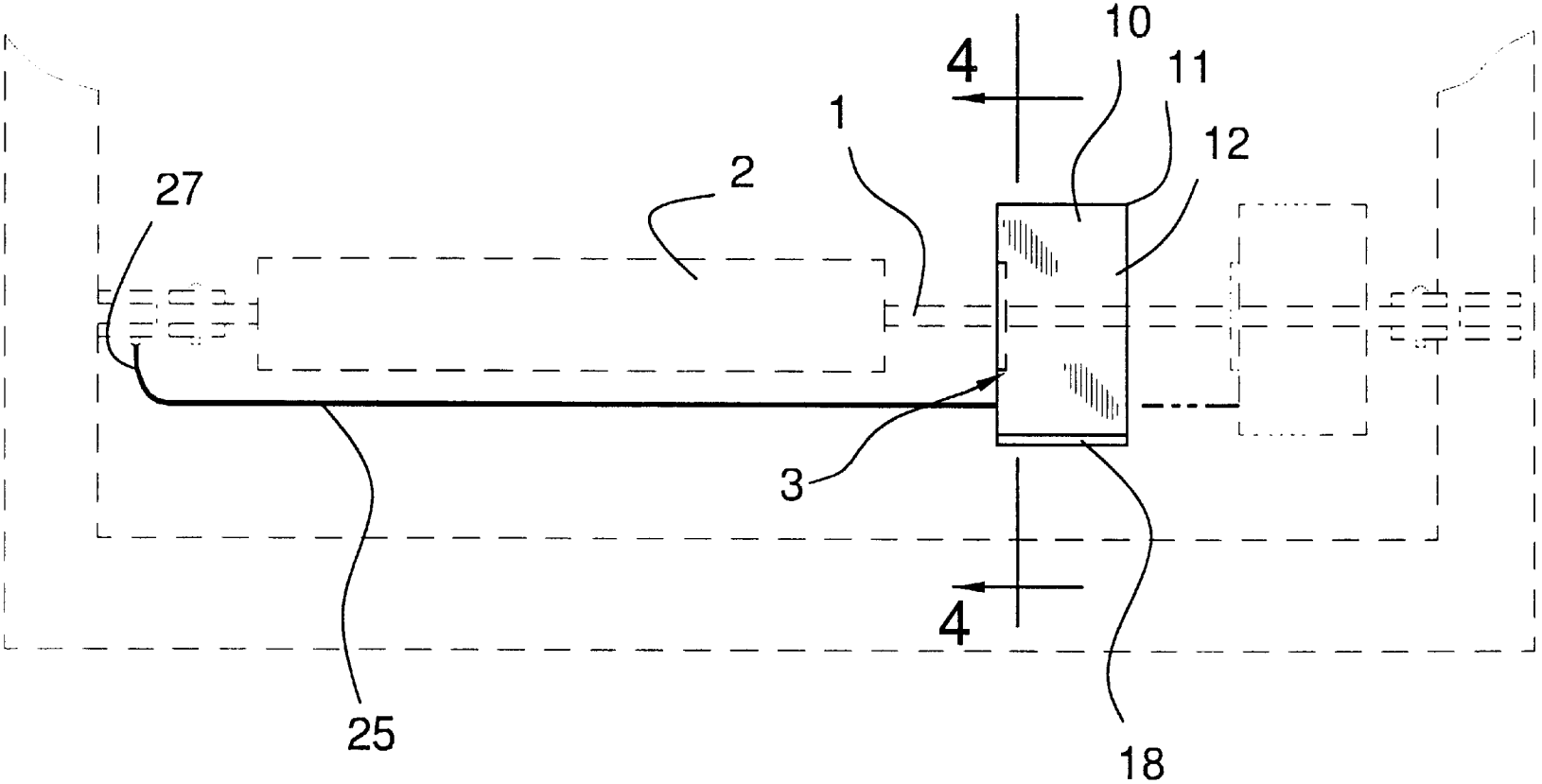
FIG. 2 is a side view of the present invention shown in use.
Figure 3:
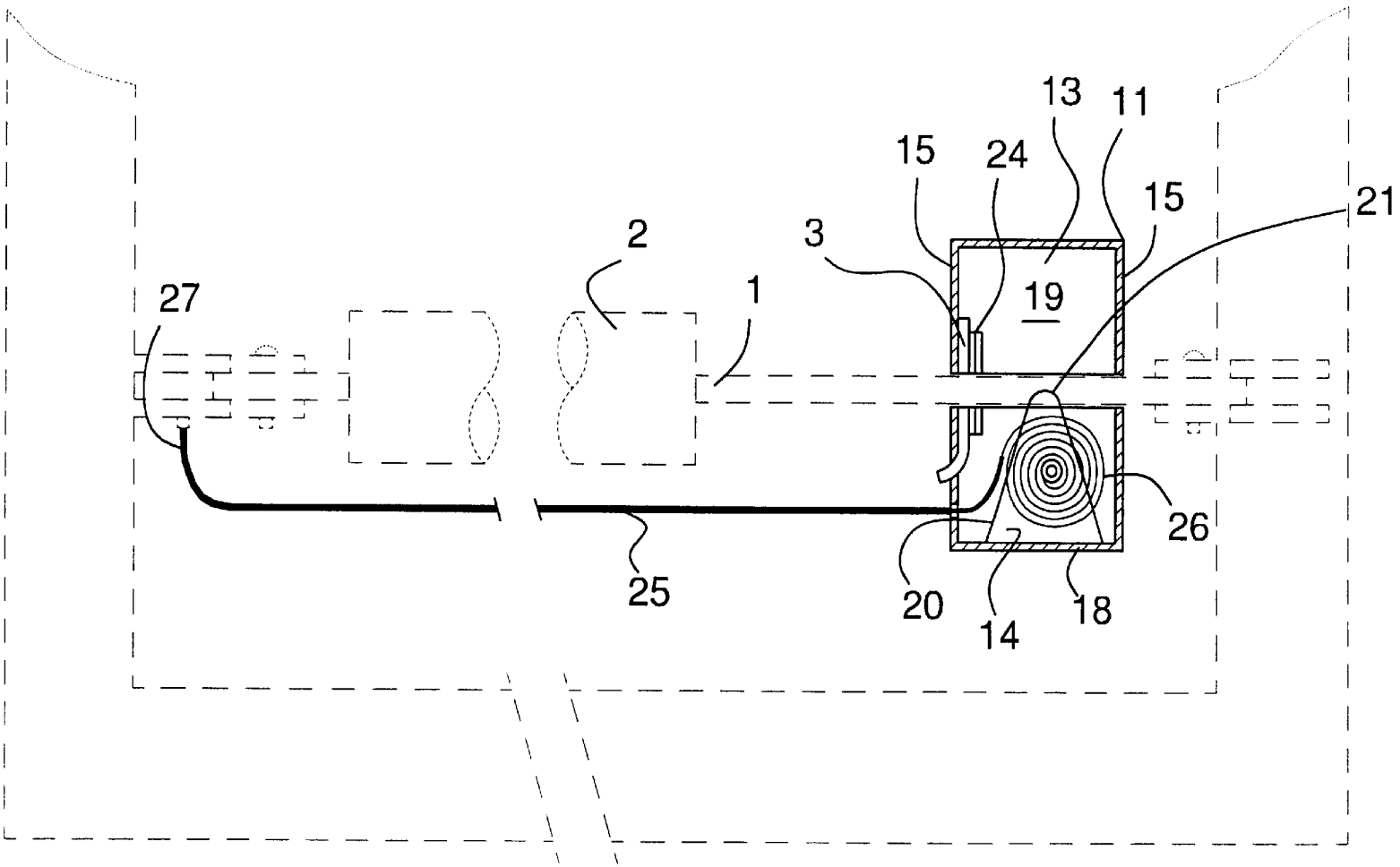
FIG. 3 is a cross-sectional view of the present invention taken along line 3—3 of FIG. 1.
Figure 4:
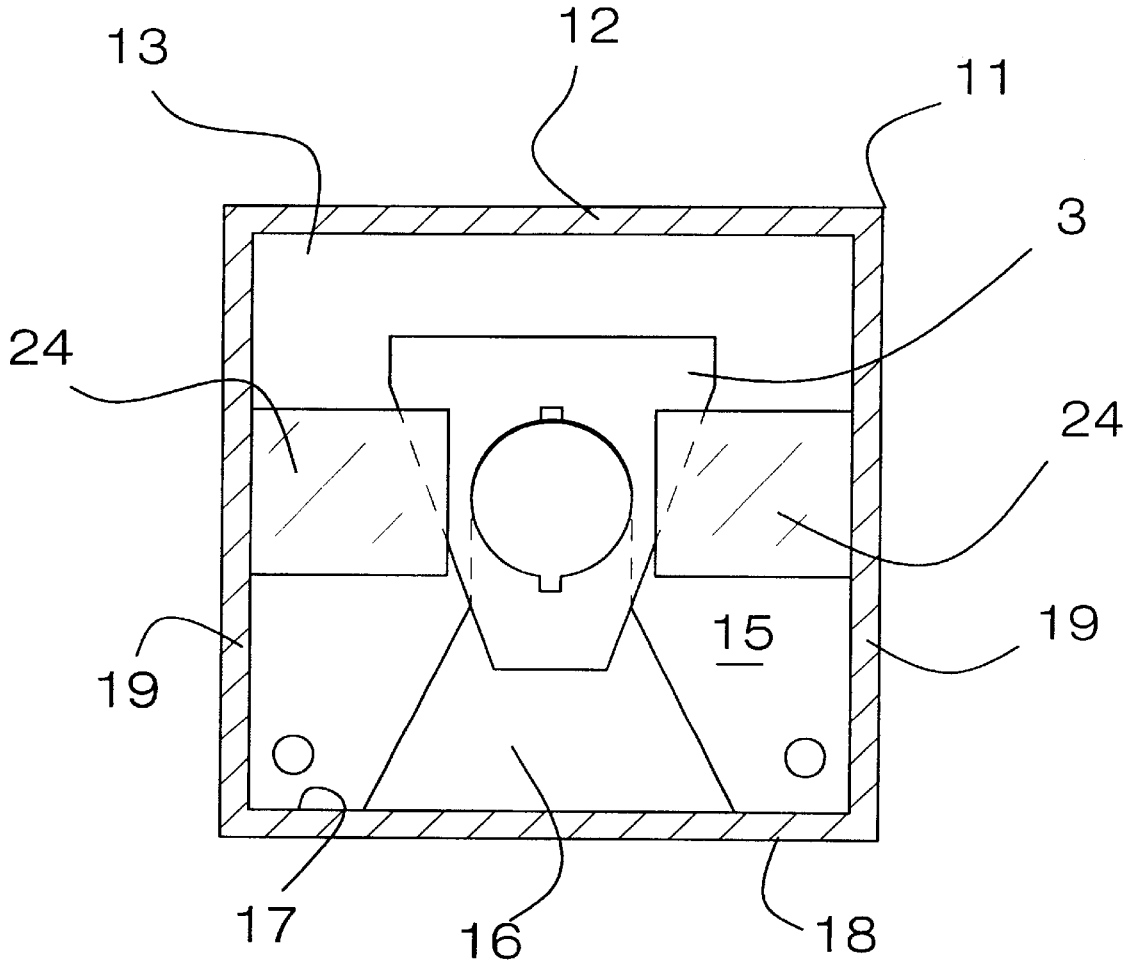
FIG. 4 is a cross-section view of the present invention taken along line 4—4 of FIG. 2.
Figure 5:
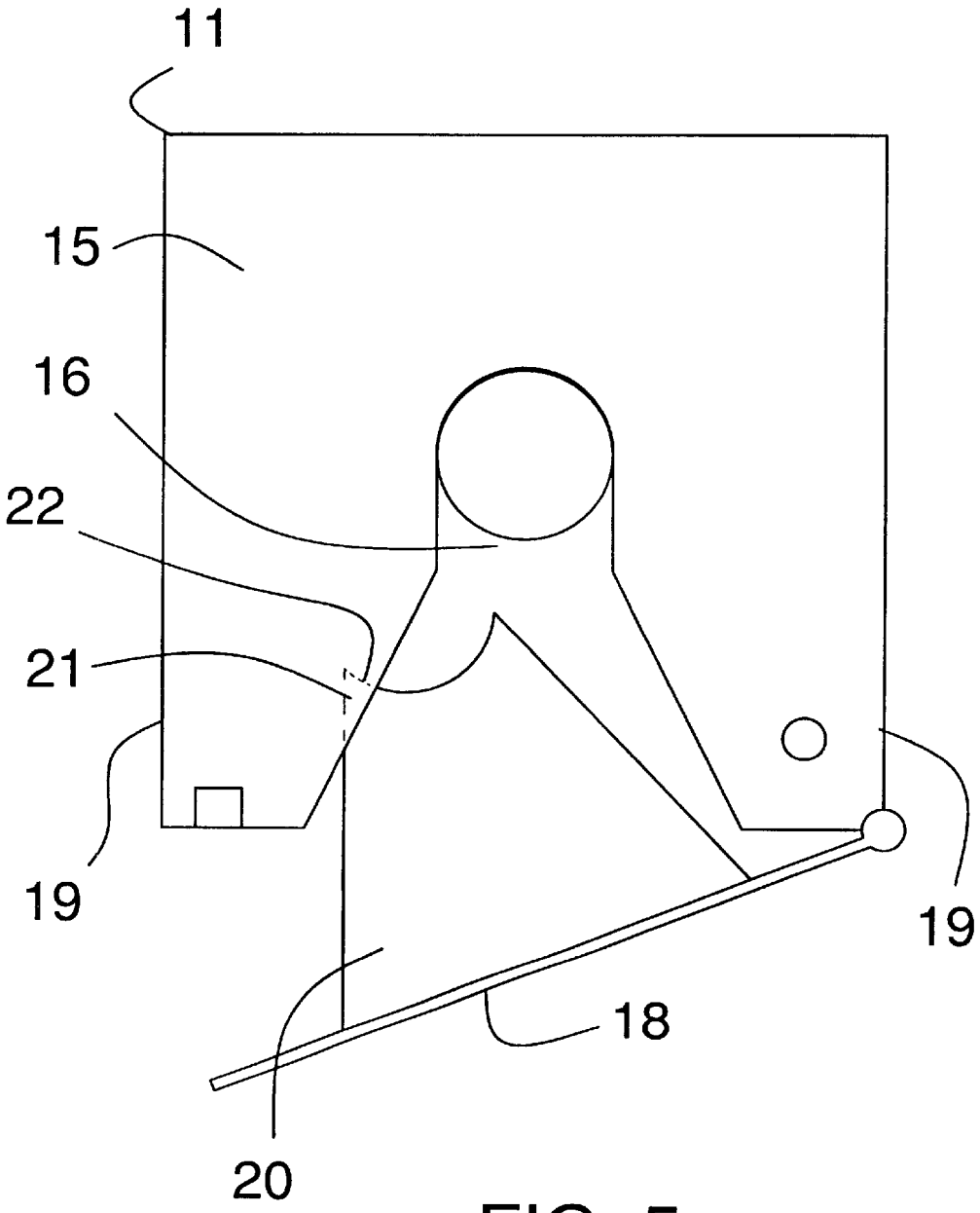
FIG. 5 is a front view of the present invention showing the bottom wall in the open position.
Figure 6:
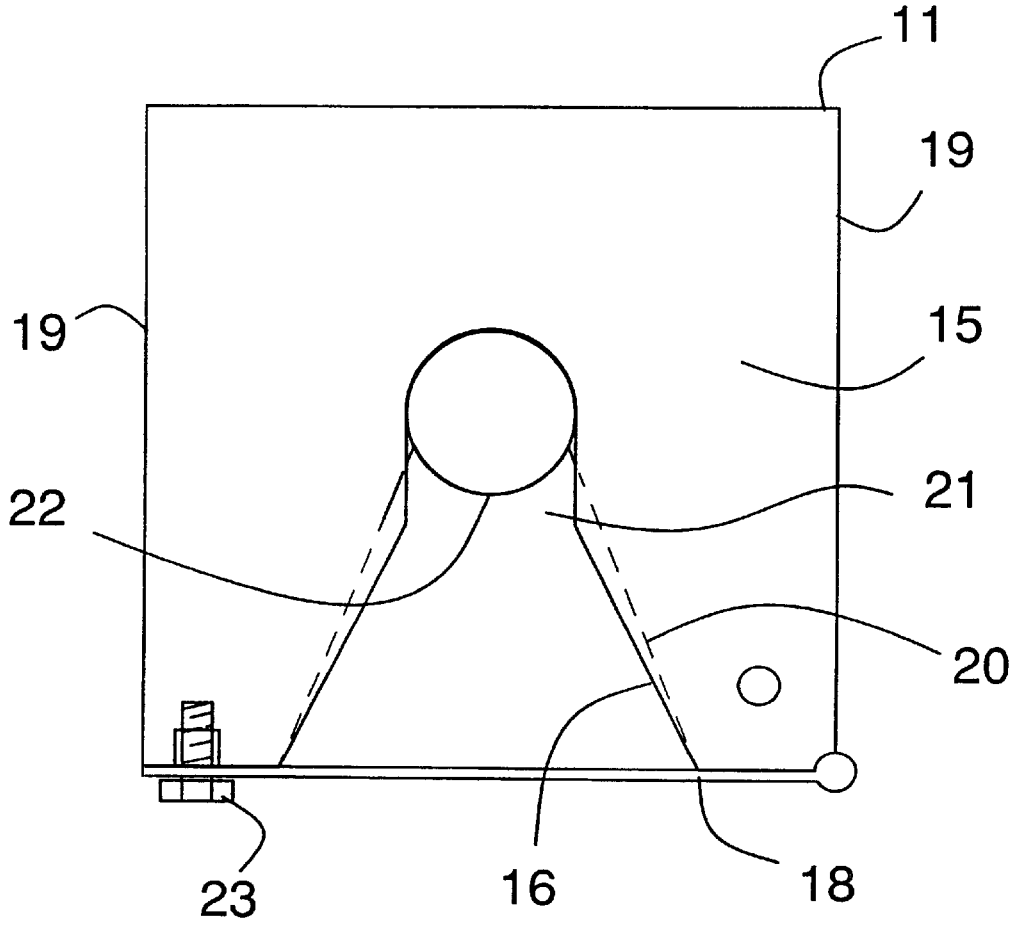
FIG. 6 is a front view of the present invention showing the bottom wall in the closed position.

With reference now to the drawings, and in particular to FIGS. 1 through 6 thereof, a new door securing device embodying the principles and concepts of the present invention and generally designated by the reference numeral 10 will be described.

As best illustrated in FIGS. 1 through 6, the door securing device 10 generally comprises a housing 11 comprising a perimeter wall 12. The perimeter wall 12 defines an interior space 13 of the housing 11. The housing 11 is designed for being slidably positioned on a door rod 1 of the screen door opposite a door cylinder 2 of the screen door.

A cable assembly 14 is positioned in the interior space 13 of the housing 11. The cable assembly 14 is designed for being coupled to the screen door opposite the housing 11. The cable assembly 14 is designed for drawing the housing 11 towards the door cylinder 2 whereby the housing 11 engages the door cylinder 2 and the door rod 1 to maintain the door cylinder 2 in position on the door rod 1 for inhibiting closing of the screen door.

The perimeter wall 12 of the housing 11 comprises a pair of side walls 15. Each of the side walls 15 comprises a slot 16 extending from a bottom edge 17 of the associated one of the side walls 15. The slot 16 of each of the side walls 15 is designed for receiving the door rod 1 for positioning the housing 11 around the door rod 1.

The perimeter wall 12 of the housing 11 comprises a bottom wall 18. The bottom wall 18 is hingably coupled to one of a pair of end walls 19 of the perimeter wall 12. The bottom wall 18 is pivotal from a closed position to an open position to permit the door rod 1 to be removed from the slot 16*s* in the side walls 15 for permitting removal of the housing 11 from the door rod 1.

A securing member 20 is coupled to the bottom wall 18 of the housing 11. The securing member 20 is positionable in the interior space 13 of the housing 11 when the bottom wall 18 is in the closed position. The securing member 20 is designed for engaging the door rod 1 of the screen door for maintaining alignment of the housing 11 with the door rod 1.

The securing member 20 comprises a free end 21. The free end 21 of the securing member 20 has a concave depression 22. The concave depression 22 is designed for seating the door rod 1 in the free end 21 of the securing member 20 for inhibiting slipping of the securing member 20 from the door rod 1 when the housing 11 is sliding on the door rod 1.

A locking member 23 is selectively extendable through the bottom wall 18 of the housing 11 and engages one of the side walls 15 of the housing 11. The locking member 23 secures the bottom wall 18 to the associated one the side walls 15 when the bottom wall 18 is in the closed position.

A pair of retaining members 24 are positioned in the interior space 13 of the housing 11. Each of the retaining members 24 is coupled to one of the side walls 15 of the perimeter wall 12. Each of the retaining members 24 is designed for securing a stop tab 3 of the screen door to the associated one of the side walls 15 for maintaining alignment of the stop tab 3 with the door rod 1 for inhibiting closing of the door when the housing 11 is abutting the door cylinder 2. The retaining members 24 are loosely positioned around the stop tab 3 to allow the stop tab 3 to pivot with respect to door rod 1 for inhibiting closing of the screen door.

The cable assembly 14 comprises a cable member 25 and a winding portion 26. The cable member 25 extends through the perimeter wall 12 of the housing 11 whereby a distal end 27 of the cable member 25 is designed for being coupled to the screen door opposite the housing 11. The winding portion 26 is coupled to the housing 11. The winding portion 26 winds the cable member 25 onto the winding portion 26 for drawing the housing 11 towards the door cylinder 2 when the screen door is opened.

In use, the user pivots the bottom wall 18 to open position and slides the door rod 1 into the slot 16*s* of the side walls 15. The stop tab 3 is positioned between the retaining members 24 and the associated one of the side walls 15. The bottom wall 18 is pivoted to the closed position and the securing member 20 engages the door rod 1. The free end 21 of the cable member 25 is coupled to screed door opposite the housing 11. As the screen door is opened the winding portion 26 winds the cable back onto the winding portion 26 to maintain proximity to the door cylinder 2 and as the screen door is open fully the stop tab 3 is tipped against door rod 1 and presses against the associated one of the side walls 15 to engage the door cylinder 2 to inhibit movement of the door cylinder 2 with respect the rod member. To close the door the user needs only to push the door closed and allow the biasing force of the door cylinder 2 to close the screen door.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door securing device for securing a screen door in an open position, the door securing device comprising:

a housing comprising a perimeter wall, said perimeter wall defining an interior space of said housing, said housing being adapted for being slidably positioned on a door rod of the screen door opposite a door cylinder of the screen door; and a cable assembly being positioned in said interior space of said housing, said cable assembly being adapted for being coupled to said screen door opposite said housing, said cable assembly being adapted for drawing said housing towards the door cylinder such that said housing engages the door cylinder and the door rod to maintain the door cylinder in position on the door rod for inhibiting closing of the screen door.

2. The door securing device as set forth in claim 1, further comprising:

said perimeter wall of said housing comprising a pair of side walls, each of said side walls comprising a slot extending from a bottom edge of the associated one of said side walls, said slot of each of said side walls being adapted for receiving the door rod for positioning said housing around the door rod.

3. The door securing device as set forth in claim 2, further comprising:

said perimeter wall of said housing comprising a bottom wall, said bottom wall being hingably coupled to one of a pair of end walls of said perimeter wall, said bottom wall being pivotal from a closed position to an open position to permit the door rod to be removed from said slots in said side walls for permitting removal of said housing from the door rod.

4. The door securing device as set forth in claim 3, further comprising:

a securing member being coupled to said bottom wall of said housing, said securing member being positionable in said interior space of said housing when said bottom wall is in the closed position, said securing member being adapted for engaging the door rod of the screen door for maintaining alignment of said housing with the door rod.

5. The door securing device as set forth in claim 4, further comprising:

said securing member comprising a free end, said free end of said securing member having a concave depression, said concave depression being adapted for seating the door rod in said free end of said securing member for inhibiting slipping of said securing member from the door rod when said housing is sliding on the door rod.

6. The door securing device as set forth in claim 3, further comprising:

a locking member being selectively extendable through said bottom wall of said housing and engaging one of said side walls of said housing, said locking member securing said bottom wall to the associated one said side walls when said bottom wall is in the closed position.

7. The door securing device as set forth in claim 1, further comprising:

a pair of retaining members being positioned in said interior space of said housing, each of said retaining members being coupled to one of a pair of side walls of said perimeter wall, each of said retaining members being adapted for securing a stop tab of the screen door to the associated one of said side walls for maintaining alignment of the stop tab with the door rod for inhibiting closing of the door when said housing is abutting the door cylinder.

8. The door securing device as set forth in claim 1, further comprising:

said cable assembly comprising a cable member and a winding portion, said cable member extending through said perimeter wall of said housing such that a distal end of said cable member is adapted for being coupled to the screen door opposite said housing, said winding portion being coupled to said housing, said winding portion winding said cable member onto said winding portion for drawing said housing towards the door cylinder when the screen door is opened.

9. A door securing device for securing a screen door in an open position, the door securing device comprising:

a housing comprising a perimeter wall, said perimeter wall defining an interior space of said housing, said housing being adapted for being slidably positioned on a door rod of the screen door opposite a door cylinder of the screen door;

a cable assembly being positioned in said interior space of said housing, said cable assembly being adapted for being coupled to said screen door opposite said housing, said cable assembly being adapted for drawing said housing towards the door cylinder such that said housing engages the door cylinder and the door rod to maintain the door cylinder in position on the door rod for inhibiting closing of the screen door;

said perimeter wall of said housing comprising a pair of side walls, each of said side walls comprising a slot extending from a bottom edge of the associated one of said side walls, said slot of each of said side walls being adapted for receiving the door rod for positioning said housing around the door rod;

said perimeter wall of said housing comprising a bottom wall, said bottom wall being hingably coupled to one of a pair of end walls of said perimeter wall, said bottom wall being pivotal from a closed position to an open position to permit the door rod to be removed from said slots in said side walls for permitting removal of said housing from the door rod;

a securing member being coupled to said bottom wall of said housing, said securing member being positionable in said interior space of said housing when said bottom wall is in the closed position, said securing member being adapted for engaging the door rod of the screen door for maintaining alignment of said housing with the door rod;

said securing member comprising a free end, said free end of said securing member having a concave depression, said concave depression being adapted for seating the door rod in said free end of said securing member for inhibiting slipping of said securing member from the door rod when said housing is sliding on the door rod;

a locking member being selectively extendable through said bottom wall of said housing and engaging one of said side walls of said housing, said locking member securing said bottom wall to the associated one said side walls when said bottom wall is in the closed position;

a pair of retaining members being positioned in said interior space of said housing, each of said retaining members being coupled to one of said side walls of said perimeter wall, each of said retaining members being adapted for securing a stop tab of the screen door to the associated one of said side walls for maintaining alignment of the stop tab with the door rod for inhibiting closing of the door when said housing is abutting the door cylinder; and said cable assembly comprising a cable member and a winding portion, said cable member extending through said perimeter wall of said housing such that a distal end of said cable member is adapted for being coupled to the screen door opposite said housing, said winding portion being coupled to said housing, said winding portion winding said cable member onto said winding portion for drawing said housing towards the door cylinder when the screen door is opened.

* * * * *